US011512686B2

(12) United States Patent
Lucon et al.

(10) Patent No.: US 11,512,686 B2
(45) Date of Patent: Nov. 29, 2022

(54) MECHANICAL RESONANT PUMP

(71) Applicant: Montana Technological University, Butte, MT (US)

(72) Inventors: Peter Lucon, Butte, MT (US); Emily Maynard, Butte, MT (US); Grace Ostermiller, Butte, MT (US)

(73) Assignee: Montana Technological University, Butte, MT (US)

( * ) Notice: Subject to any disclaimer, the term of this patent is extended or adjusted under 35 U.S.C. 154(b) by 9 days.

(21) Appl. No.: 16/841,389

(22) Filed: Apr. 6, 2020

(65) Prior Publication Data

US 2020/0318625 A1 Oct. 8, 2020

Related U.S. Application Data

(60) Provisional application No. 62/829,829, filed on Apr. 5, 2019.

(51) Int. Cl.

| | |
|---|---|
| ***F04B 35/04*** | (2006.01) |
| ***F04B 39/00*** | (2006.01) |
| ***F04B 17/04*** | (2006.01) |
| ***F04B 9/06*** | (2006.01) |
| ***F04B 37/14*** | (2006.01) |
| ***F04B 23/06*** | (2006.01) |

(52) U.S. Cl.

CPC ..... *F04B 35/045* (2013.01); *F04B 39/0044* (2013.01); *F04B 9/06* (2013.01); *F04B 17/04* (2013.01); *F04B 17/042* (2013.01); *F04B 17/044* (2013.01); *F04B 23/06* (2013.01); *F04B 37/14* (2013.01)

(58) Field of Classification Search

CPC .. F04B 35/045; F04B 39/0044; F04B 17/042; F04B 17/04; F04B 9/06; F04B 37/14; F04B 17/044; F04B 23/06

See application file for complete search history.

(56) References Cited

U.S. PATENT DOCUMENTS

| | | | | |
|---|---|---|---|---|
| 4,353,220 | A | 10/1982 | Curwen et al. | |
| 7,188,993 | B1 | 3/2007 | Howe et al. | |
| 8,905,624 | B1 | 12/2014 | Howe et al. | |
| 2008/0112829 | A1* | 5/2008 | Hell | F04B 35/045 417/546 |

(Continued)

OTHER PUBLICATIONS

Dainez; An adaptive resonant controller applied to a linear resonant compressor—Applicant submitted NPL (Year: 2019).*

(Continued)

*Primary Examiner* — Kenneth J Hansen
*Assistant Examiner* — David N Brandt
(74) *Attorney, Agent, or Firm* — Midtown Intellectual Property, PC; C A Schlecht

(57) ABSTRACT

Provided herein is a mechanical resonant system, comprising a frame; at least one pump disposed on the frame; one or two masses coupled to the frame by a first plurality of resilient members; and at least one voice coil actuator disposed within the frame and coupled to the at least one pump or to the one or two masses; wherein when the system comprises two masses, a second plurality of resilient members couple the masses to each other. Also provided are methods for using these mechanical resonant systems to evacuate a chamber, to compress air, or sense changes in pressure.

14 Claims, 17 Drawing Sheets

(56) References Cited

U.S. PATENT DOCUMENTS

| | | | | |
|---|---|---|---|---|
| 2016/0236162 | A1* | 8/2016 | Lucon | H02K 3/30 |
| 2017/0074255 | A1* | 3/2017 | Asayama | F04B 19/22 |
| 2017/0096987 | A1* | 4/2017 | Asayama | F04B 1/02 |

OTHER PUBLICATIONS

Dainez, Paulo Sergio, et al. "A linear resonant compressor model based on a new linearization method of the gas pressure force." *International Journal of Refrigeration* 48 (2014): 201-209.

Dainez, Paulo Sergio, José de Oliveira, and Ademir Nied. "An adaptive resonant controller applied to a linear resonant compressor." *International Journal of Refrigeration* 104 (2019): 521-529.

Operating and Installation Instructions, Diaphragm Vacuum Pumps, KNF 121254-121522, KNF Neuberger GmbH, Freiburg, Germany (May 2014).

Wang, Jiantao, et al. "A resonant piezoelectric diaphragm pump transferring gas with compact structure." *Micromachines* 7.12 (2016): 219.

"Air Compressor, Vacuum Pump & Liquid Pump Linear Products Overview," Lk059b, Nitto Kohki, Tokyo, Japan, downloaded Sep. 21, 2021.

* cited by examiner

MECHANICAL RESONANT PUMP

This application claims the benefit of priority of U.S. Provisional Patent Application Ser. No. 62/829,829 filed Apr. 5, 2019, the disclosure of which is incorporated by reference in its entirety for all purposes.

Vacuum pumps and compressors are notoriously inefficient, loud and vibrate. Previous attempts to use mechanical resonant systems to reduce this noise and vibration have been unsuccessful, partly because the systems were only partially resonant and relied only upon the piston pressure for the spring, which itself is non-linear and subject to loss.

The system disclosed herein solves these problems by providing a more efficient vacuum pump, which saves money and makes power loads on machines easier to meet. The disclosed systems permit larger inlet ports using a larger piston, cancel the forces to the frame and ultimately the ground. In several embodiments, two masses move out of phase of one another. Spring rates are sized to reduce the net force to or near zero that is transmitted to the frame and ultimately to the ground. In certain embodiments, the system comprised multiple pump heads, for example to obtain high vacuum and quick compression in a compressor applications. In this embodiment, the system is a multiple stage pumping systems.

The present disclosure provides a mechanical resonant system, comprising: a frame; at least one pump disposed on the frame; one or two masses coupled to the frame by a first plurality of resilient members; and at least one voice coil actuator disposed within the frame and coupled to the at least one pump or to the one or two masses; wherein when the system comprises two masses, a second plurality of resilient members couple the masses to each other. In certain embodiments, the voice coil actuator comprises a bobbin, a magnet, and a magnet housing; the pump comprises a pump head, piston, and barrel; the piston is disposed within the barrel and beneath the pump head; and the piston is coupled to one of the bobbin or the magnet housing. In certain embodiments, the system has a resonance frequency and on resonance the input force is on phase with of the velocity of the one or two masses.

The present disclosure also provides a mechanical resonant system comprising a frame comprising a plurality of plates and a plurality of standoffs; at least one pair of pumps disposed on opposite sides of the frame; two masses operatively coupled to the frame by a first plurality of resilient members; a second plurality of resilient members coupling the two masses to each other; and at least one voice coil actuator within the frame and coupled to the at least one pump or the one or two masses.

In certain embodiments, the at least one voice coil actuator is disposed between and coupled to each of the at least one pair of pumps. In certain embodiments, the at least one voice coil actuator comprises a bobbin, a magnet, and a magnet housing; each of the at least one pair of pumps comprises a pump head, piston, and barrel; each piston is disposed within each barrel and beneath each pump head; and the piston of one pump is coupled to the bobbin and the piston of the other pump is coupled to the magnet housing. In certain embodiments, the system further comprises a third plurality of resilient members disposed between the frame and ground, whereby the frame functions as a third mass in the system.

The present disclosure further provides a method for evacuating a chamber, comprising operating a mechanical resonant system described herein in fluid communication with the chamber. In certain embodiments, the system comprise one pair of pumps disposed on opposite sides of the frame, wherein one pump pulls and the other pump pushes. In certain embodiments, during operation the system has a resonance frequency, and, on resonance, the input force is on phase with of the velocity of the one or two masses.

The present disclosure also provides a method for compressing air, comprising operating a mechanical resonant system described herein.

Additional embodiments and features are set forth in part in the description that follows, and in part will become apparent to those skilled in the art upon examination of the specification, or may be learned by the practice of the embodiments discussed herein. A further understanding of the nature and advantages of certain embodiments may be realized by reference to the remaining portions of the specification and the drawings, which forms a part of this disclosure.

BRIEF DESCRIPTION OF THE DRAWINGS

The disclosure will be readily understood by the following detailed description in conjunction with the accompanying drawings, wherein like reference numerals designate like structural elements. The drawings provide exemplary embodiments or aspects of the disclosure and do not limit the scope of the disclosure.

Figure 1:
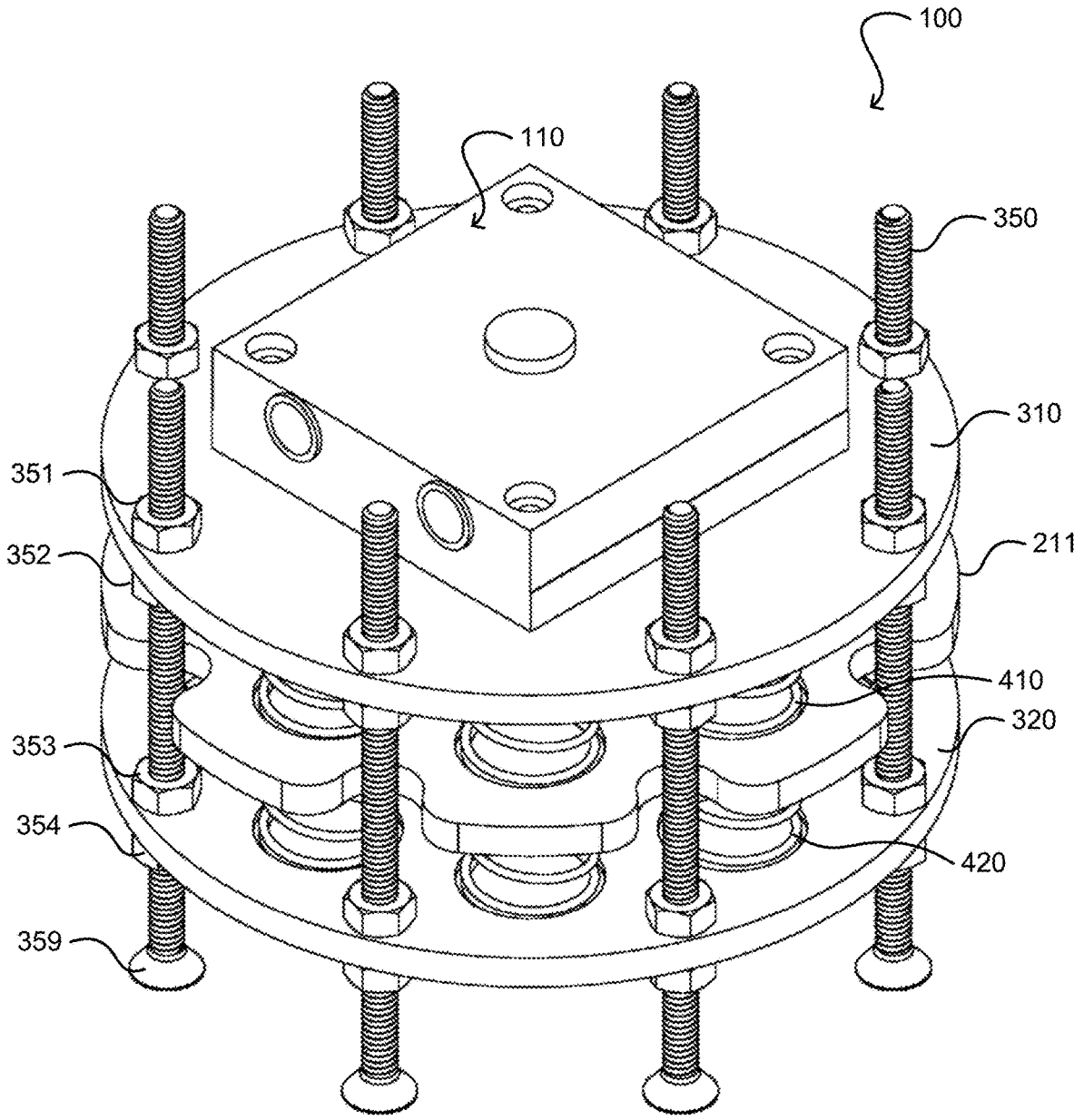
FIG. 1 depicts a plan view of the disclosed system with a first mass, with the moving mass and pump plunger in the center.
Figure 2:
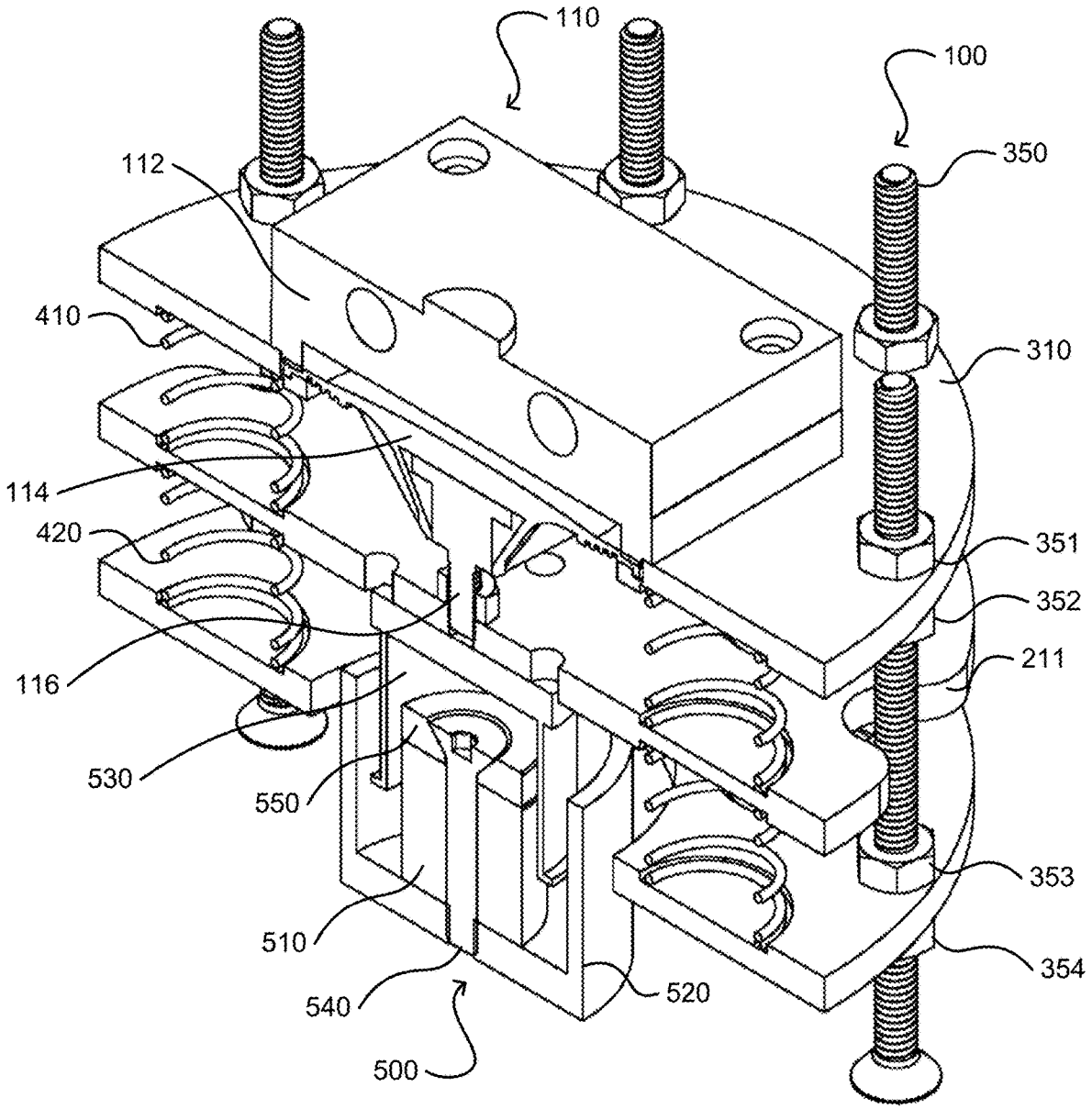
FIG. 2 depicts a cross-sectional view of the one-mass system of FIG. 1.
Figure 3:
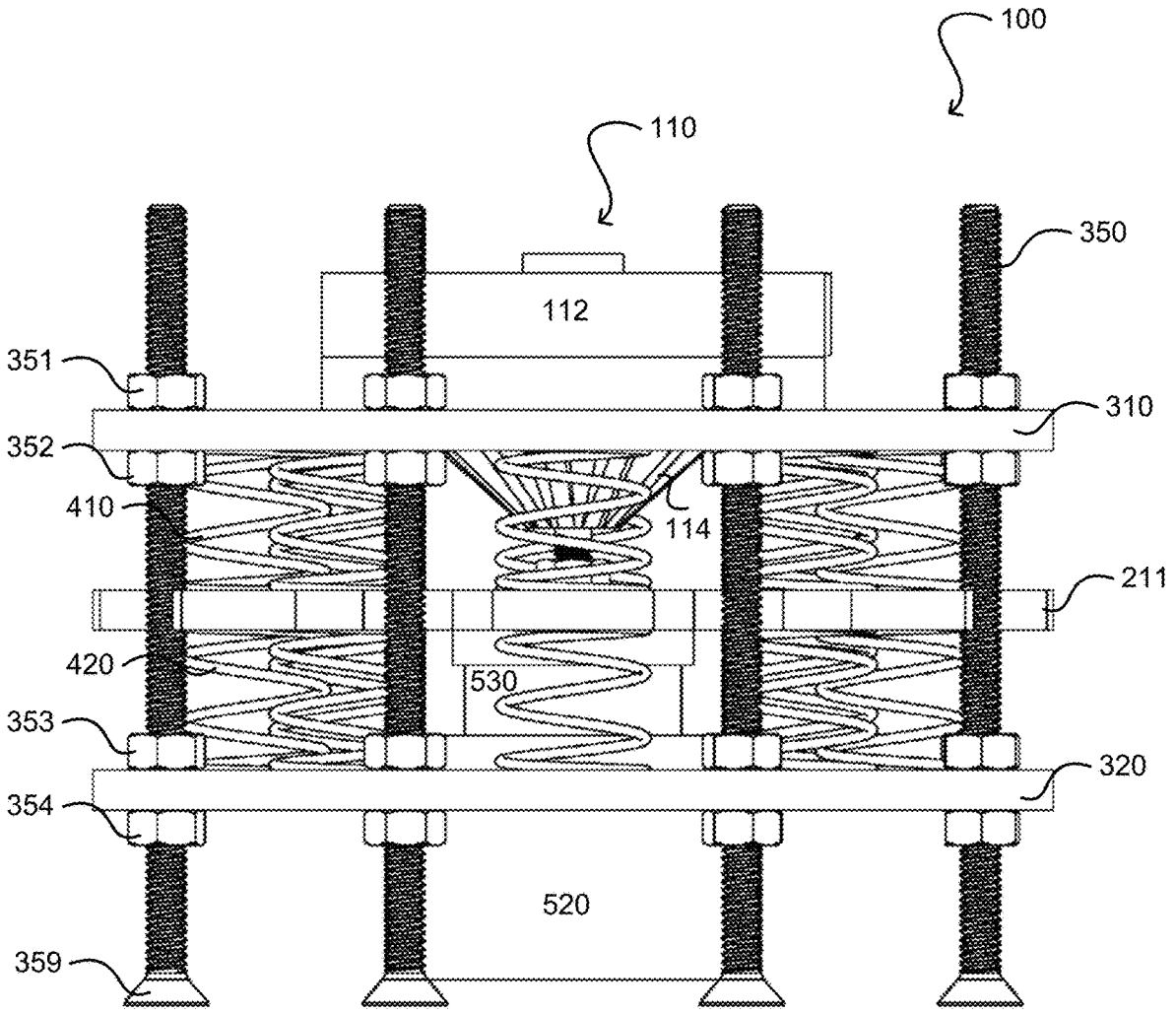
FIG. 3 depicts a side view of the one-mass system of FIG. 1.
Figure 4:
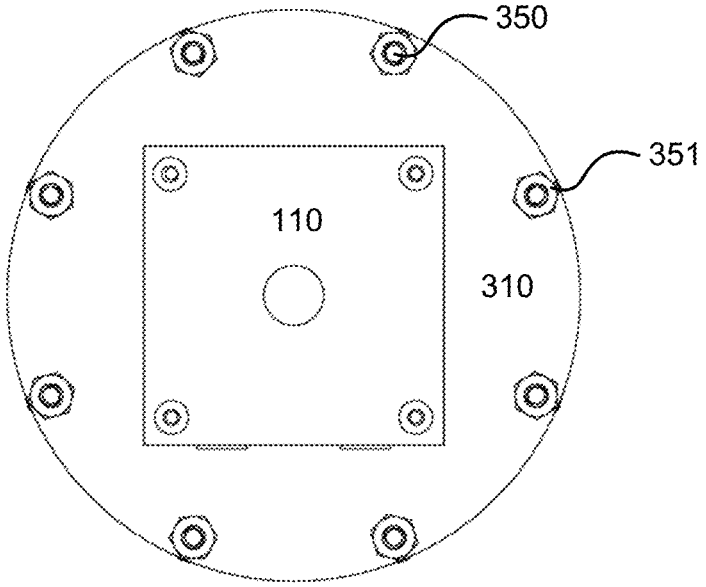
FIG. 4 depicts a top view of the one-mass system of FIG. 1.
Figure 5:
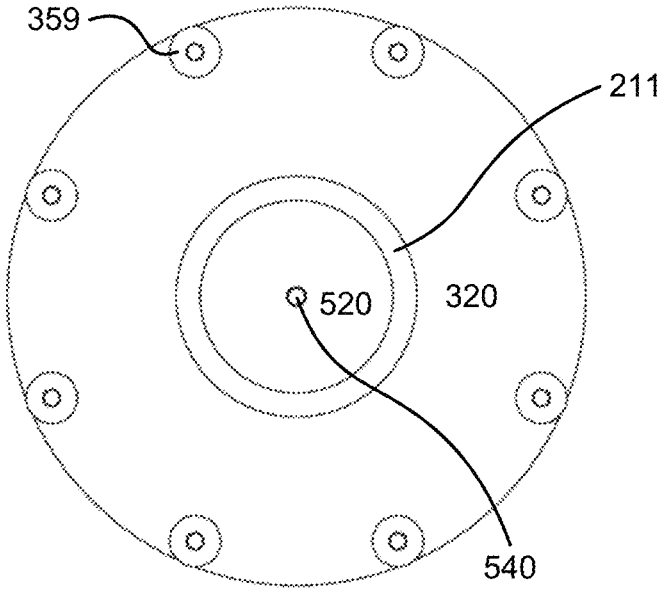
FIG. 5 depicts a bottom view of the one-mass system of FIG. 1.
Figure 6:
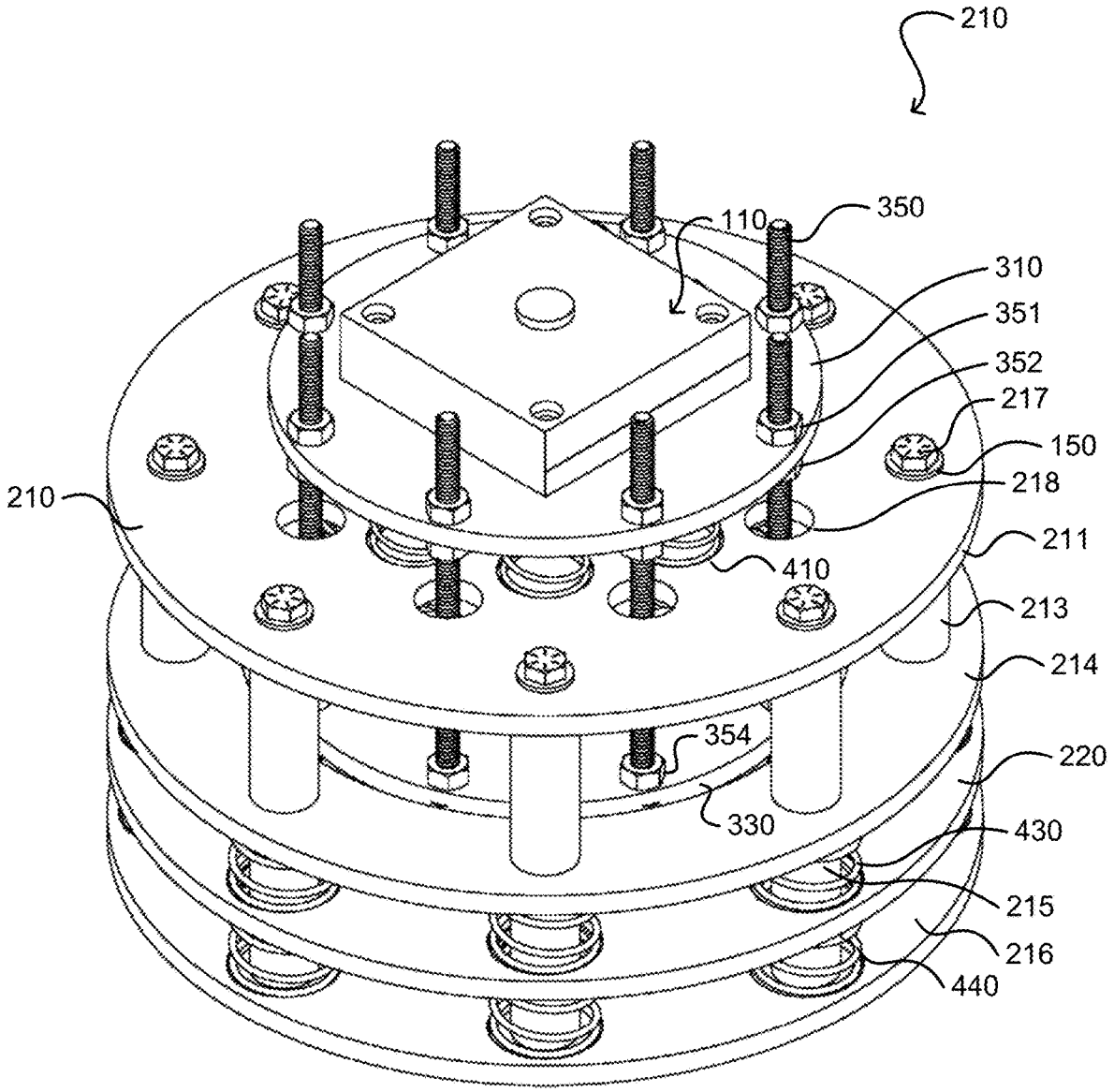
FIG. 6 depicts a plan view of the disclosed system comprising first and second masses and first and second pumps, with the moving masses and pump pistons in the center.
Figure 7:
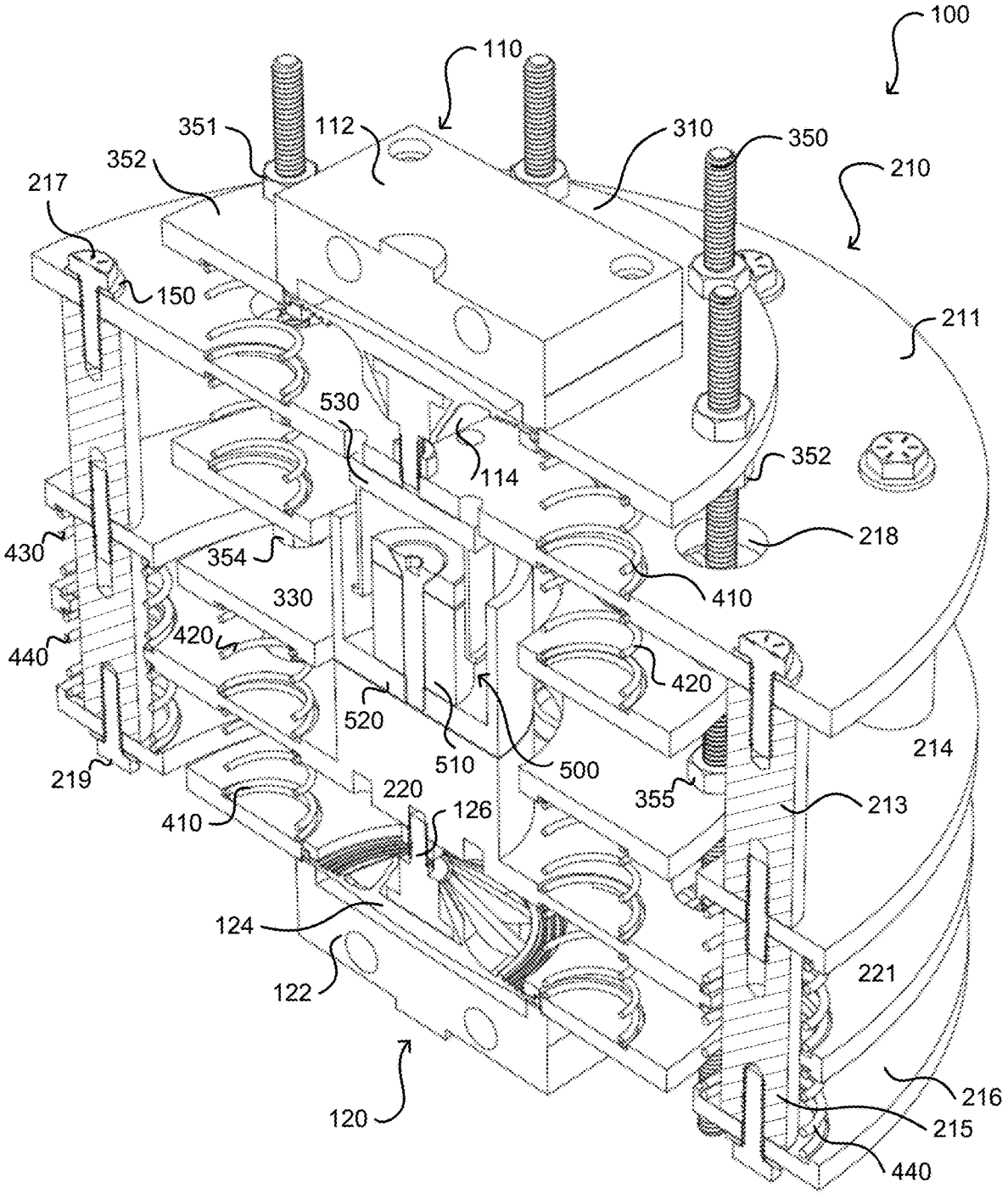
FIG. 7 depicts a cross-sectional view of the two-mass system of FIG. 6.
Figure 8:
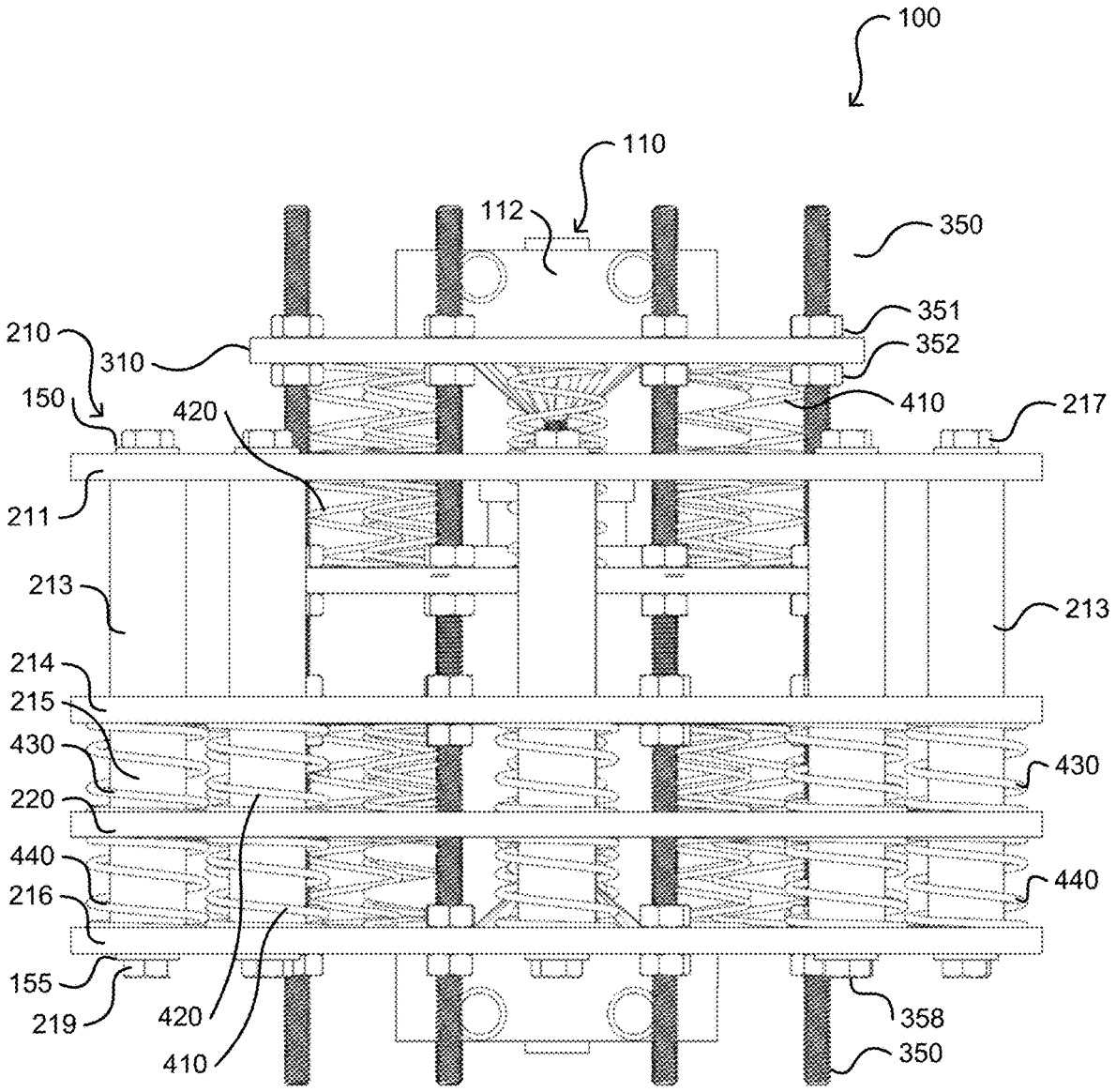
FIG. 8 depicts a side view of the two-mass system of FIG. 6.
Figure 9:
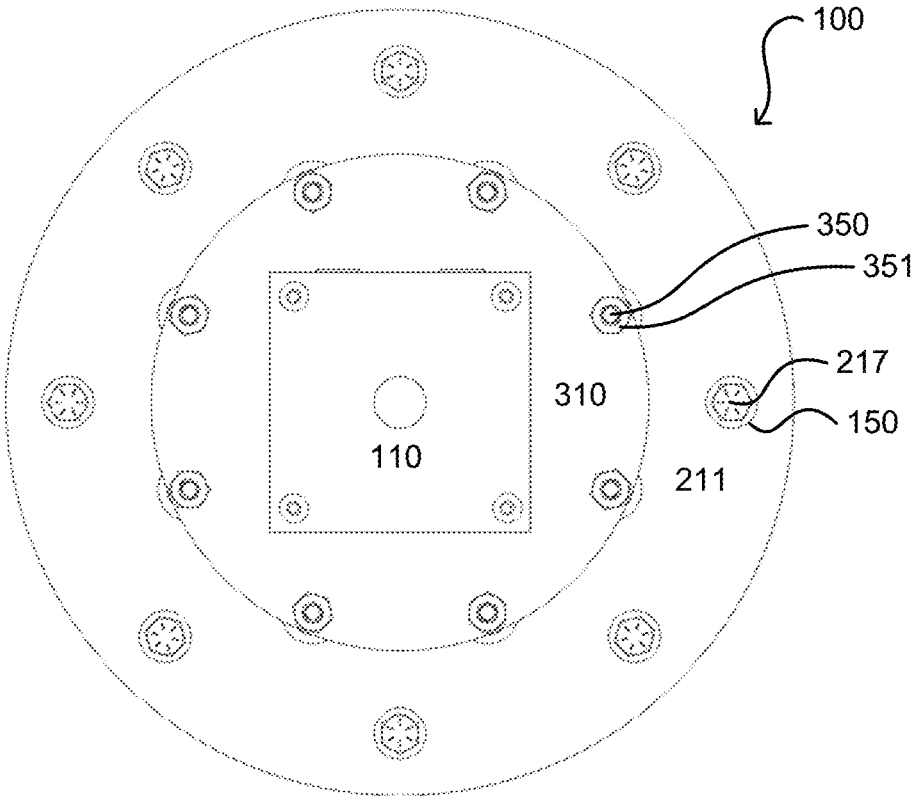
FIG. 9 depicts a top view of the two-mass system of FIG. 6.
Figure 10:
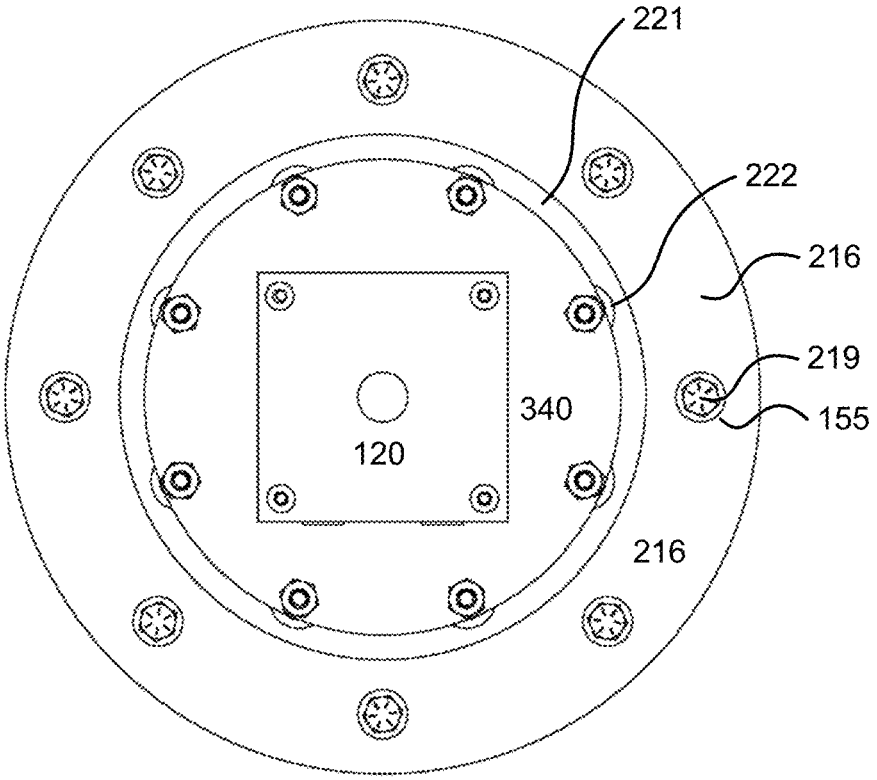
FIG. 10 depicts a bottom view of the two-mass system of FIG. 6.
Figure 11:
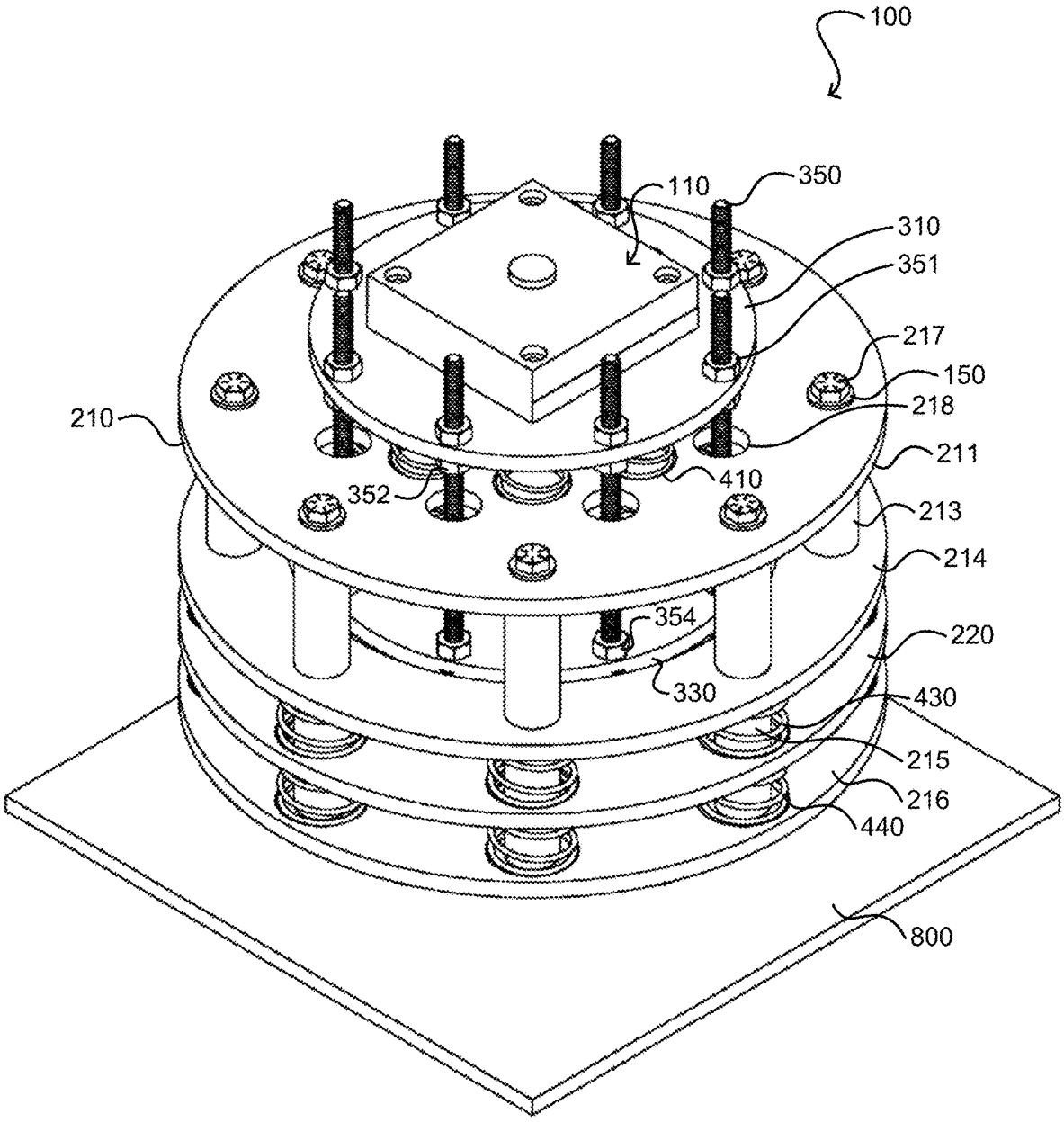
FIG. 11 depicts a plan view of the disclosed system with first, second, and third masses and first and second pumps, with the moving mass and pump plunger in the center.
Figure 12:
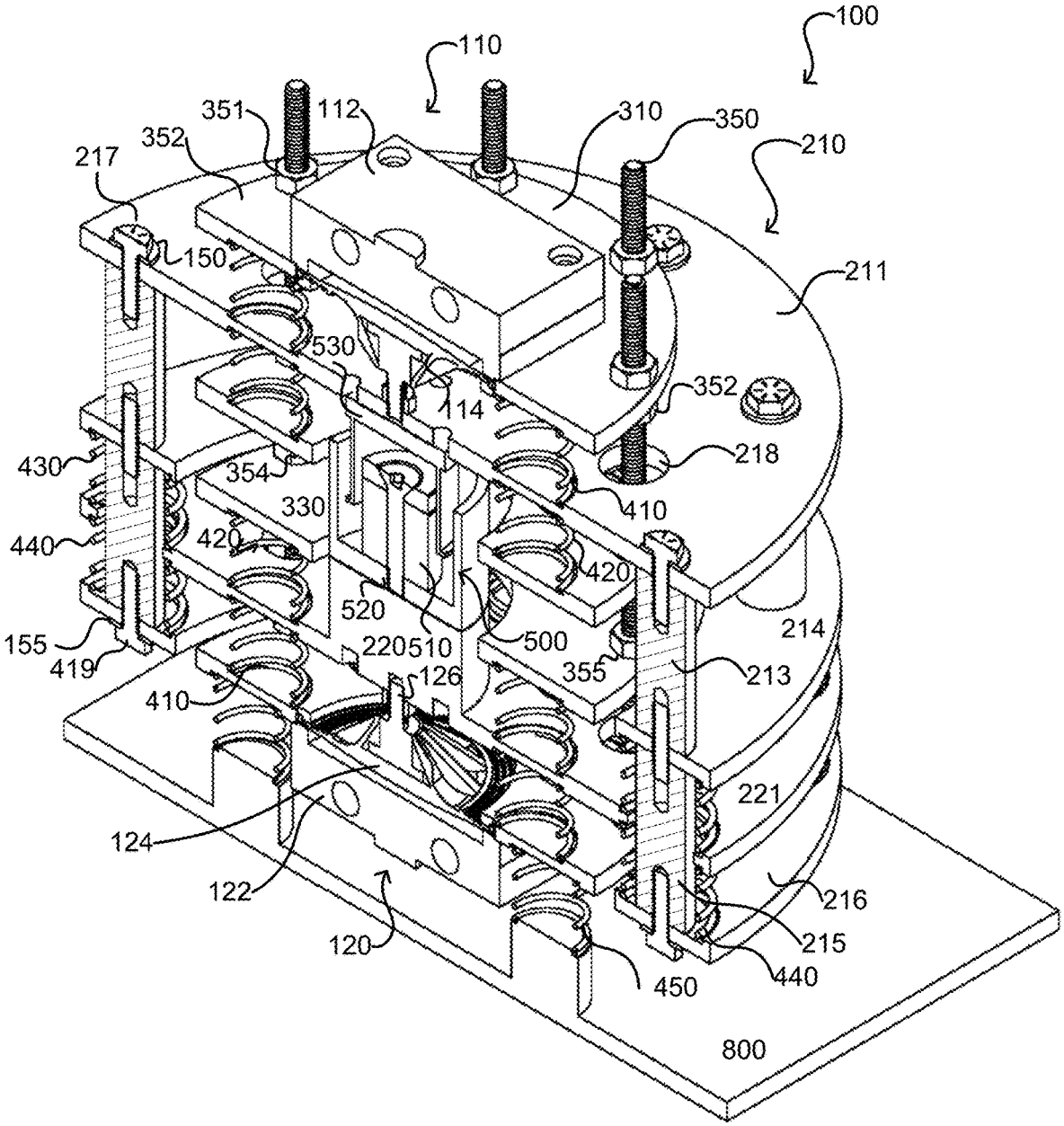
FIG. 12 depicts a cross-sectional view of the three-mass system of FIG. 11.
Figure 13:
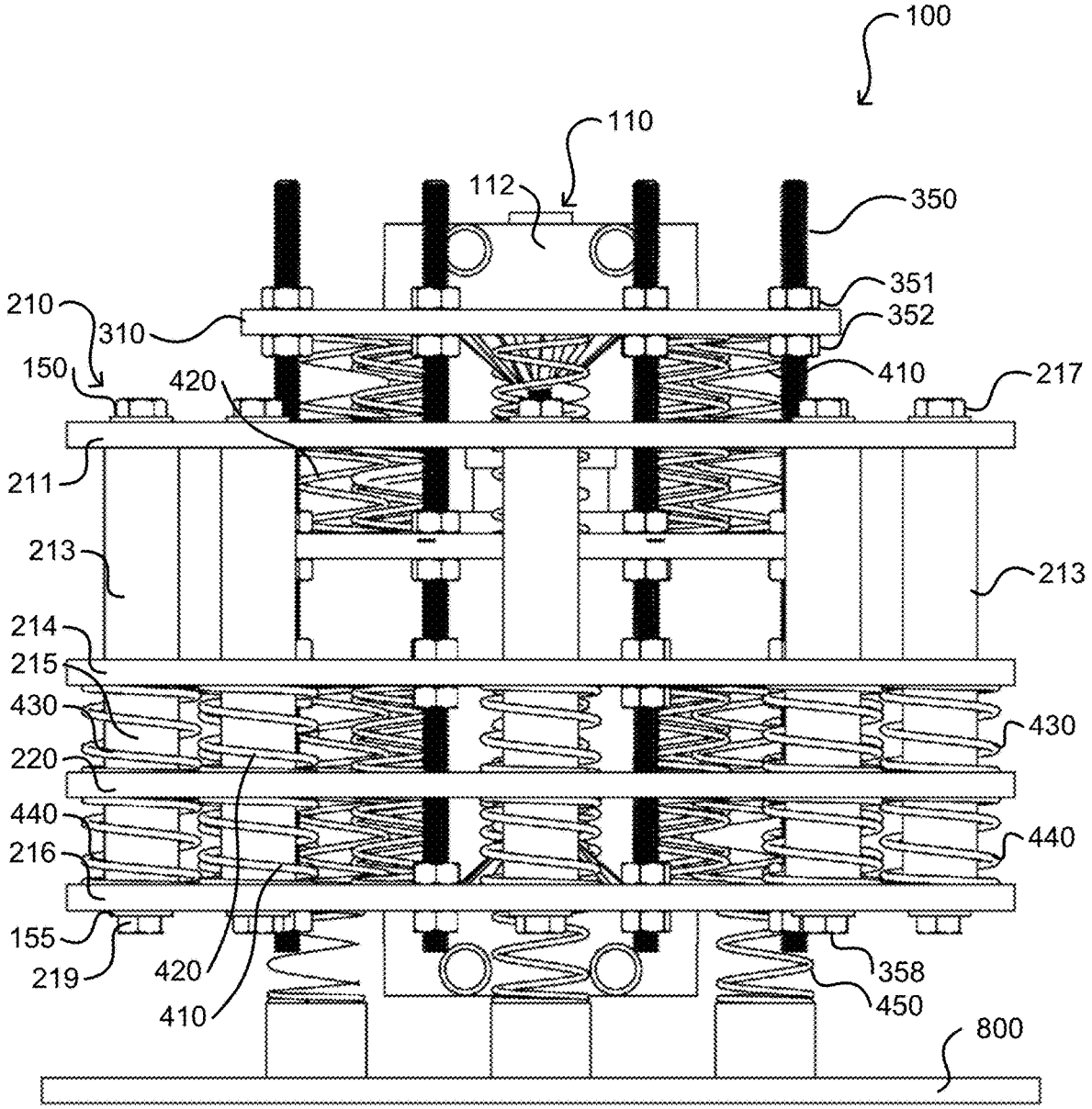
FIG. 13 depicts a side view of the three-mass system of FIG. 11.
Figure 14:
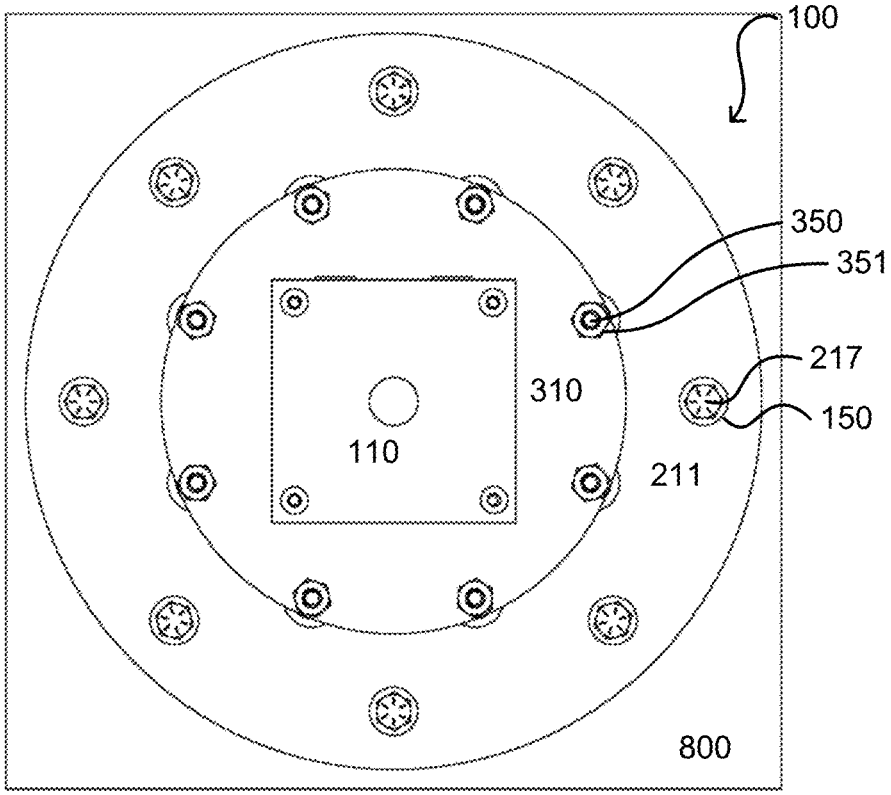
FIG. 14 depicts a top view of the three-mass system of FIG. 11.
Figure 15:
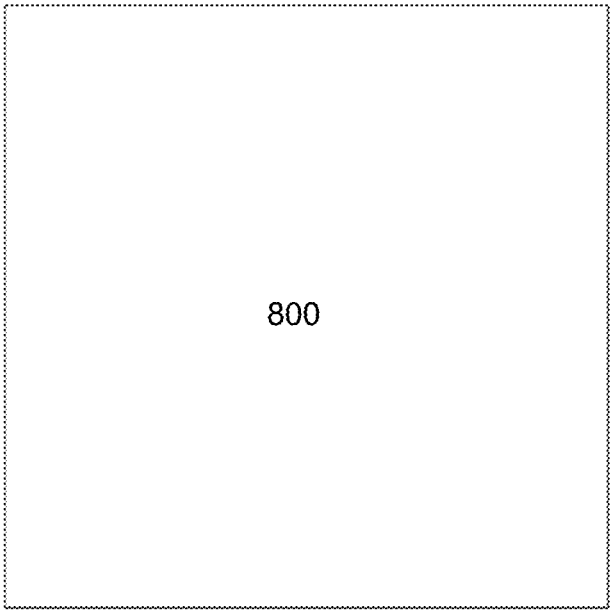
FIG. 15 depicts a bottom view of the three-mass system of FIG. 11.

The present disclosure may be understood by reference to the following detailed description, taken in conjunction with the drawings as described above. For illustrative clarity, certain elements in various drawings may not be drawn to scale, may be represented schematically or conceptually, or otherwise may not correspond exactly to certain physical configurations of embodiments.

DETAILED DESCRIPTION

Provided herein is a system, used for example as a vacuum pump or an compressor, wherein reciprocating action of the pump uses a mechanical resonant system. The disclosed mechanical resonant system is the first of its kind to cancel the forces within the system for a pumping apparatus. The force cancellation of masses minimizes force to ground and conserves energy within the system. The system is also first of its kind to have multiple pump heads in the same system operating out of phase of one another, such that a higher pumping rate can be attained, when one pump is pulling and the other pump is pushing.

Generally, the mechanical resonant system comprises springs 400 and masses 200 arranged to cancel out the motion forces to ground. Adding masses to a system typically increases input forces and increases power to drive the system. The disclosed systems use resonance, which substantially decreases the input force for a minimal increase in system power input. The plurality of masses cancels the vibration forces to ground for a single frequency and greatly reduces vibration of the frame. The plurality pistons within the pumps allows the system to function as a multiple stage compressor or vacuum pump.

Referring to FIGS. 1-5, a mechanical resonant system 100 comprises a frame 300, a pump 110 disposed on the frame 300, a mass 200 coupled to the frame 300 by a first plurality of resilient members 400, and a voice coil actuator 500 disposed beneath and coupled to the pump 110. The pump 110 is disposed in the center of the proximal end of the frame 300. The pump 110 comprises a pump head 112 operatively coupled to a barrel 116 containing a piston 114. The frame 300 comprises two plates 310,320 joined together by a plurality of eight standoffs 350 evenly distributed near the periphery of the plates 310,320. Each standoff 350 is joined to the first plate 310 with a pair of nuts 351,352 and to two the second plate 320 with another pair of nuts 353,354. In certain embodiments, the standoff 350 is coupled to a foot 359 at the distal end to aid contact with ground 800.

Standoffs provide strength and rigidity to the system, such that separate resonant modes do not occur within the structure of the system. For instance, each mass 200 is assumed to be a rigid body and the standoffs 350 ensure that each mass acts as rigid body during system operation. The number of standoffs in the plurality can be selected to accommodate the size of the system, such as between 1 and 100, for example 1, 2, 3, 4, 5, 6, 7, 8, 9, 10, 15, 20, 25, 30, 35, 40, 45, 50, 75, or 100. That is, a large system typically contains more standoffs than a smaller system to provide sufficient strength and rigidity. Each standoff 350 is matched with springs 410,420 and nuts 351,352,353,354, so as the number of standoff 350 increases so do the number of springs and nuts.

Referring again to FIGS. 1-5, the mass 200 comprises a second mass plate 221 disposed between the first frame plate 310 and second frame plate 320. Second mass plate 221 is coupled to first frame plate 310 by a plurality frame-to-mass springs 410. Second mass plate 221 is coupled to second frame plate 320 by a plurality of mass-to-frame springs 420.

The mechanical resonant systems disclosed herein comprise at least a first plurality of resilient members 400. Suitable examples of resilient members include, but are not limited to, spiral springs, leaf springs, pneumatic springs, rubber springs, piezoelectric variable springs, and pneumatic variable springs. Generally, spring characteristics and mass weights are chosen such that the resonant condition is achievable in the mechanical resonant system 100. In certain embodiments, variable resilient members are substituted for springs to change the resonant frequency. This substitution allows for a larger variability without sacrificing performance. Variable resilient members can be either mechanically or electronically controlled. Suitable examples of such variable resilient members include, but are not limited to, air filled bellows, variable length leaf springs, coil spring wedges, piezoelectric bi-metal springs, and other members which can be used as a resilient member which can have its spring rate changed or otherwise affected.

Mechanical resonant systems 100, such as air compressors and vacuum pumps, may comprise an actuator in the form of a voice coil to drive/operate the system. When present, for example as depicted in FIGS. 1-5, the voice coil actuator 500 comprises a bobbin 530, an electrical conductor and a magnet assembly. In this embodiment of the one-mass system, the voice coil actuator 500 is disposed beneath and coupled to the pump 110. Alternatively, the voice coil actuator 500 may be coupled to mass 200.

The electrical conductor is coupled to the bobbin 530. The magnet 510 is coupled to magnet housing 520. At least a portion of the bobbin 530 and at least a portion of the electrical conductor are configured to be positioned within a gap formed by the magnet 510 and the housing 520. The bobbin 530 and the magnet 510 are configured to oscillate when an alternating current is applied to the electrical conductor. The pump 110 is coupled to one of the bobbin 530 or the magnet housing 550. Alternatively, the mass 200 is coupled to one of the bobbin 530 or the magnet housing 550.

In some embodiments, the voice coil actuator 500 is a first voice coil actuator, and the system further comprises a second voice coil actuator coupled to one of the masses 200 and to one of the pistons 114. In some embodiments, the second voice coil actuator is configured to operate as a driver for the system by driving the mass 200 in phase with the first voice coil actuator. In other embodiments, the second voice coil actuator is configured to operate as a brake for the system by driving the masses 180° out of phase from the first voice coil actuator.

In certain embodiments, the mechanical resonant system 100 further comprises a cooling system coupled to the voice coil actuator 500. In some embodiments, an opening is positioned along a longitudinal axis of the magnet 510. In some embodiments, the electrical conductor comprises a plurality of coil wraps coupled to the bobbin 530. In some embodiments, the air flow is generated by oscillation of the bobbin 530 and the magnet assembly. In some embodiments, the magnet assembly comprises a first group of magnets coupled to the housing and a second group of magnets positioned above the first group of magnets. The first group of magnets is coupled to the second group of magnets by a guide shaft. In certain embodiments, a magnet from the first group of magnets is arranged with its polarity opposite to the polarity of a magnet from the second group of magnets.

In some embodiments, the cooling system comprises a fan configured to circulate the air flow. In other embodiments, the cooling system comprises a vibratory pumper flap configured to pump the air flow as the bobbin and the magnet assembly oscillate. In some embodiments, the actuator comprises a voltage-controlled amplifier configured to drive the actuator. In other embodiments, the actuator comprises a current-controlled amplifier configured to drive the voice coil actuator.

In some embodiments, the bobbin material comprises a plastic material. In other embodiments, the bobbin material comprises a ferrite material. In some embodiments, the housing is made from a magnetically conductive material. Use of an electrically non-conductive bobbin can increase mechanical efficiencies to up to as much as 98% and can decrease the resistive heating, voltage and electrical current of the mechanical resonant system 100. Furthermore, the electrically non-conductive bobbin can eliminate eddy current losses typically associated with electrically conductive voice coil bobbins used in conventional resonant systems. Such eddy currents can cause significant heat energy and power loads on the system which can affect the performance and useful life of the system.

Referring now to FIGS. 6-10, this embodiment is a two-mass mechanical resonant system 100 comprising a frame 300 comprising a plurality of plates 310, 320, 330 and a plurality of standoffs 350. The first mass 210, the second mass 220, and the frame 300 are each independently moveable with respect to one another.

The frame 300 comprises four plates 310,320,330,340 joined together by a plurality of eight standoffs 350 evenly distributed near the periphery of the plates 310,320,330,340. Each standoff 350 is joined to the first plate 310 with a pair of nuts 351,352, and to the second plate 320 with a pair of nuts 353,354, to the third plate 330 with a pair of nuts 355,356, and to the fourth plate 340 with a pair of nuts 357, 358.

One pair of pumps 110,120 are disposed on opposite sides of the frame 300. The first pump 110 comprises a pump head 112, a piston 114, and a barrel 116. The piston 114 is disposed within the barrel 116 and beneath the pump head 112. The second pump 120 comprises a pump head 122, a piston 124, and a barrel 126. The piston 124 is disposed within the barrel 126 and beneath the pump head 122.

Two masses 220 consist of two mass assemblies 210,220 and are operatively coupled to the frame 300 by a first plurality of resilient members 400. The first mass assembly 210 comprises a first mass plate 211, a first spacer 213, a first ring 214, a second spacer 215, a second ring 216, a first bolt 217, and a second bolt 219. The first mass plate 211 is disposed beneath the first plate 310 and is coupled with the first bolt 217 to the first ring 214 by the first spacer 213. The first ring 214 is likewise coupled to the second ring 216 with a second bolt 219 by a second spacer 215. First mass plate 211 comprises a plurality of holes 218 to accommodate the passthrough of each standoff 350 from frame 300. First mass plate 211 of the first mass assembly 210 is coupled to first frame plate 310 by a plurality frame-to-mass springs 410. First mass plate 211 of the first mass assembly 210 is coupled to second frame plate 320 by a plurality of mass-to-frame springs 420.

The second mass assembly 220 comprises a second mass plate 221. The second mass plate 221 is coupled to the third mass plate 330 by a plurality of mass-to-frame springs 420. The second mass plate 221 is coupled to the fourth mass plate 340 by a plurality of frame-to-mass springs 410. In certain embodiments, the second mass assembly 220 comprises a second mass plate 221, a first spacer 223, a first ring 224, a second spacer 225, a second ring 226, a first bolt 227, and a second bolt 229. In this embodiment, the second mass plate 221 is disposed beneath the third plate 330 and is coupled with the first bolt 227 to the first ring 224 by the first spacer 223. The first ring 224 is likewise coupled to the second ring 226 with a second bolt 229 by a second spacer 225.

A second plurality of resilient members 430,440 couple the two mass assemblies 210,220 to each other. Specifically, the first ring 214 of the first mass assembly 210 is coupled above the second mass plate 221 by a plurality ring-to-mass springs 430. The second ring 216 of the first mass assembly 210 is coupled below the second mass plate 221 by a plurality of mass-to-ring springs 440.

A voice coil actuator 500 is disposed between and coupled to each of pair of pumps 110,120. The voice coil actuator 500 comprises a bobbin 530, a magnet 510, a magnet housing 520, a magnet housing bolt 540, and a magnet flex director 550. The piston 114 of the first pump 110 is coupled to the bobbin 530 and the piston 124 of the second pump 120 is coupled to the magnet housing 520.

For example, a mechanical resonant system 100 comprising two masses is vibrated between 162° and 198° out of phase of each other and are coupled to ground or to another mass through a second plurality of resilient members. The masses and resilient members are sized so that the forces transmitted to ground or another mass are minimized. The transmitted forces matched through the coupling springs by choosing a spring rate to transfer the displacement forces of the moving masses. The oscillations of the masses generate transmitted forces F(t) through the springs by the relation $F(t)=k*x(t)$, where k is the spring rate and x(t) is the displacement of the mass with respect to time. The force from Mass 1 can be calculated from $F_1(f_{Hz},t):=Z_1(f_{Hz})\cdot\sin(\omega_f(f_{Hz})\cdot t+\phi_1(f_{Hz}))\cdot k_2$ and the force from Mass 2 can be calculated from $F_2(f_{Hz},t):=Z_2(f_{Hz})\cdot\sin(\omega_f(f_{Hz})\cdot t+\phi_2(f_{Hz}))\cdot k_3$, where $Z_1$ is the displacement amplitude of Mass 1, $Z_2$ is the displacement amplitude of Mass 2, and Φ1 and Φ2 are the phase angle offsets from the mass displacements and the input force. The resultant force can be found by summing $F_1$ and $F_2$ together and would be the resultant force to ground for a two-mass system. See FIG. 22.

The linear force applied to the first mass produces a vibratory motion transmitted through resilient members to a second mass then to the frame. By adding a second mass, it is possible to tune the response of the system so that transmitted forces are cancelled out. The first and second masses are coupled together with resilient members to transfer the vast majority of the force to the pump and minimize the transmitted force to the ground and supporting structure. Minimizing the transmission of force to ground and maximizing the transmitted force to the pump most efficiently affects work done and reduces wear. Most efficient operation is achieved by operation at or near resonant frequencies of the mechanism. Levels of intensity that are nearly impossible with conventional methods of pumping are attained with ease by employing the mechanical resonant system disclosed herein.

Operation at the resonant condition is not necessary to achieve evacuation or compression. Operation near resonance provides substantial amplitude and accelerations to produce significant pressure differentials. Operation is typically within 10 Hz of resonance. As the frequency approaches the resonant condition, small changes produce large results (the slope of the curve-frequency vs. amplitude-changes rapidly as the resonant condition is approached).

Referring to FIGS. 11-15, in certain embodiments, the frame 300 acts a third mass 230 when coupled to ground by a plurality of resilient members 450. In this embodiment, the resultant force to ground is transferred through the additional spring and the resultant force to ground is further reduced. To minimize the forces to ground, the system operates on the second resonant mode for a two-mass system and the third resonant mode for a three-mass system, where Mass 1 and Mass 2 that vibrated between 162° and 198° out of phase of each other. Other features in the three-mass system correspond to those of the two-mass system detailed above.

Figure 16:
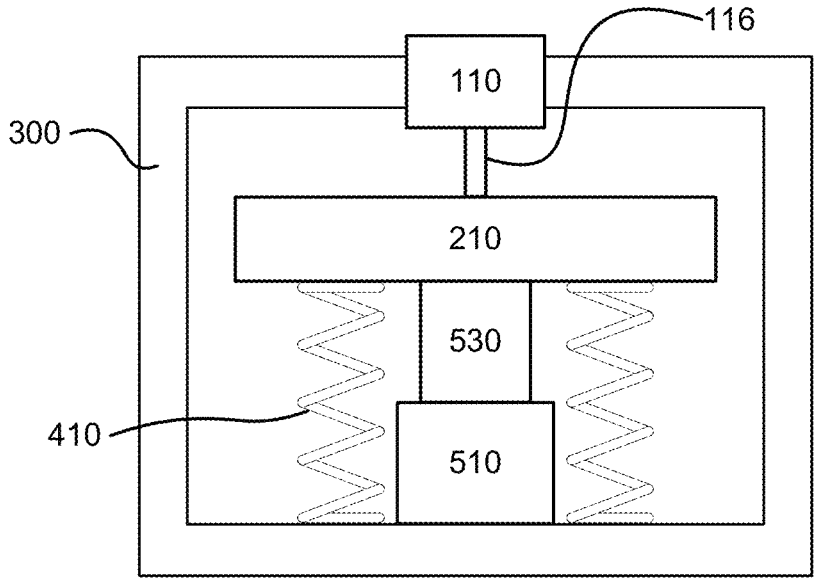
FIG. 16 conceptually depicts a mechanical resonant system with one mass, one pump, and a voice coil.

These principles are further illustrated at the conceptual drawings at FIGS. 16-19. FIG. 16 conceptually depicts a mechanical resonant system 100, comprising a frame 300, one mass 210, one pump 110 having a barrel 116, a pair of springs 410, and a voice coil actuator comprising a magnet 510 and a bobbin 530. The pump 110 is disposed in the frame 300 and is coupled to the mass 210 by the barrel 116. The mass 210 is coupled to the bobbin 530 and to the frame 300 by the pair of springs 410. The bobbin is coupled to the frame 300 by the magnet 510.

Figure 17:
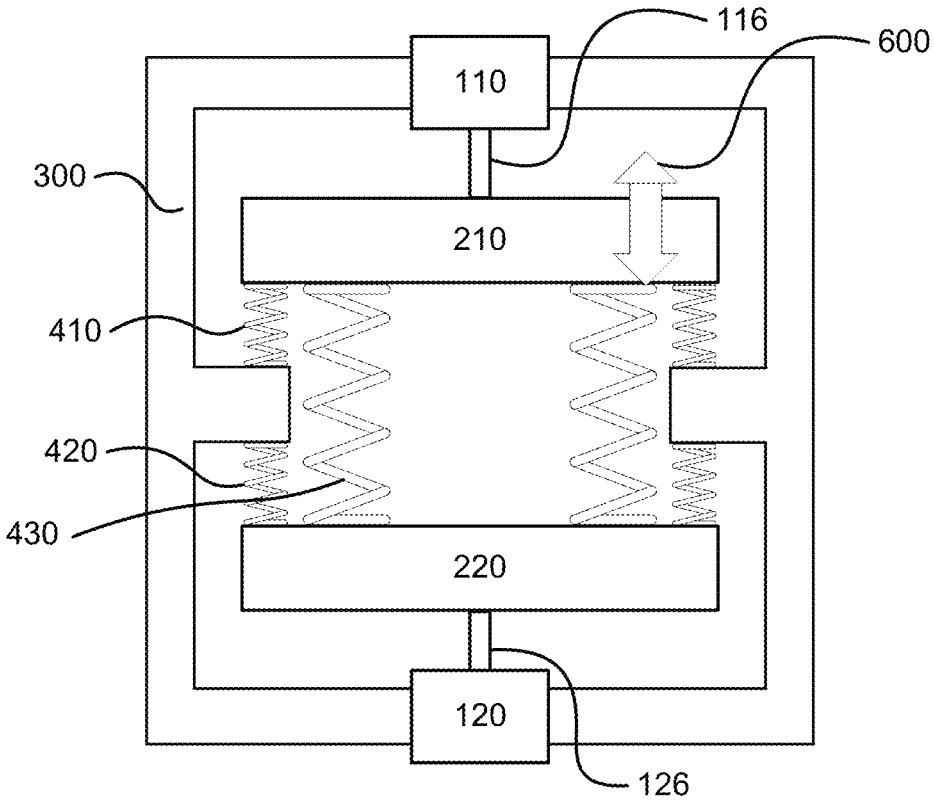
FIG. 17 conceptually depicts a mechanical resonant system with two masses, two pumps, and a spinning eccentric.

FIG. 17 conceptually depicts a mechanical resonant system 100, comprising a frame 300, two masses 210,220, two pumps 110,120, a pair of frame-to-mass springs 410, a pair of mass-to-frame springs 420, a pair of mass-to-mass springs 430, and a force function 600. The pump 110 is disposed in the frame 300 and is coupled to the mass 210 by the barrel 116. The first mass 210 is coupled to the force function 600, to the frame by a pair of frame-to-mass springs 410 and to the second mass 220 by a pair of ring-to-mass springs 430. The second mass is coupled to the frame via a pair of mass-to-frame springs 420, and to the second pump 120 by the barrel 126. The second pump is disposed in the frame 330 opposite the first pump 110. The force function may be, for example, a spinning eccentric.

Figure 18:
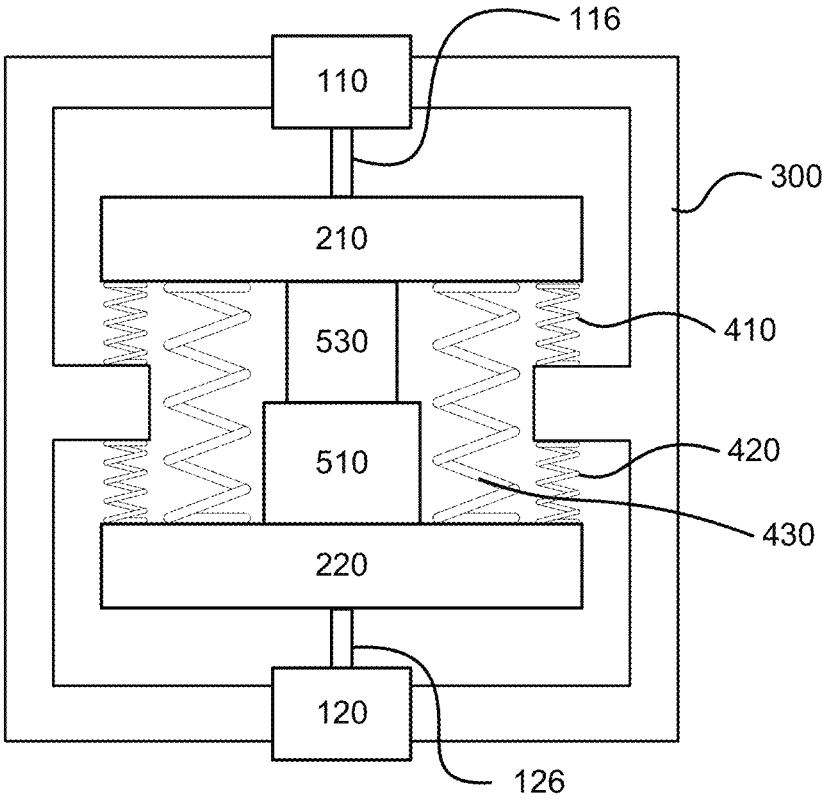
FIG. 18 conceptually depicts a mechanical resonant system with two masses, two pumps, and a voice coil.

FIG. 18 conceptually depicts a mechanical resonant system 100, comprising a frame 300, two masses 210,220, two pumps 110,120, a pair of frame-to-mass springs 410, a pair of mass-to-frame springs 420, a pair of mass-to-mass springs 430, and a voice coil actuator comprising a magnet 510 and a bobbin 530. The pump 110 is disposed in the frame 300 and is coupled to the mass 210 by the barrel 116. The first mass 210 is coupled to bobbin 530, to the frame by a pair of frame-to-mass springs 410 and to the second mass 220 by a pair of ring-to-mass springs 430. The bobbin 530 is coupled to the magnet 510. The second mass 220 is coupled to the magnet 510, to the frame 300 via a pair of mass-to-frame springs 420, and to the second pump 120 by the barrel 126. The second pump 120 is disposed in the frame 330 opposite the first pump 110.

Figure 19:
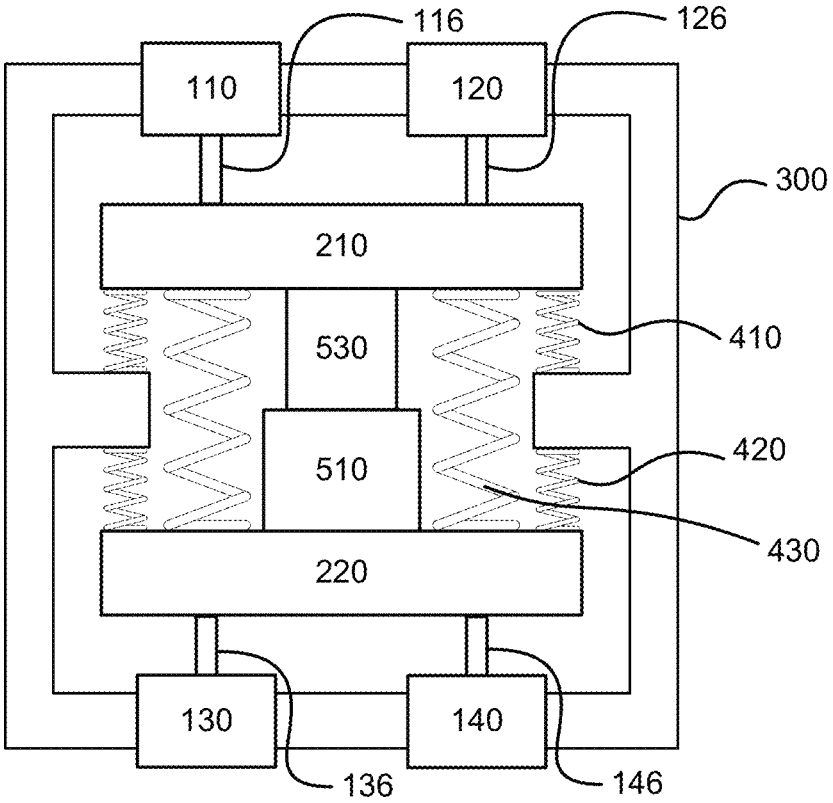
FIG. 19 conceptually depicts a mechanical resonant system with two masses, four pumps, and a voice coil.

FIG. 19 conceptually depicts a mechanical resonant system 100, comprising a frame 300, two masses 210,220, four pumps 110,120,130,140, a pair of frame-to-mass springs 410, a pair of mass-to-frame springs 420, a pair of mass-to-mass springs 430, and a voice coil actuator comprising a magnet 510 and a bobbin 530. The pumps 110,120 are disposed in the frame 300 and are coupled to the mass 210 by the barrel 116 and the barrel 126. The first mass 210 is coupled to bobbin 530, to the frame by a pair of frame-to-mass springs 410 and to the second mass 220 by a pair of ring-to-mass springs 430. The bobbin 530 is coupled to the magnet 510. The second mass 220 is coupled to the magnet 510, to the frame 300 via a pair of mass-to-frame springs 420, to the third pump 120 by the barrel 136, and to the fourth pump 140 by the barrel 146. The third pump 130 is disposed in the frame 330 opposite the first pump 110. The fourth pump is disposed in the frame 330 opposite the second pump 120.

Figure 20:
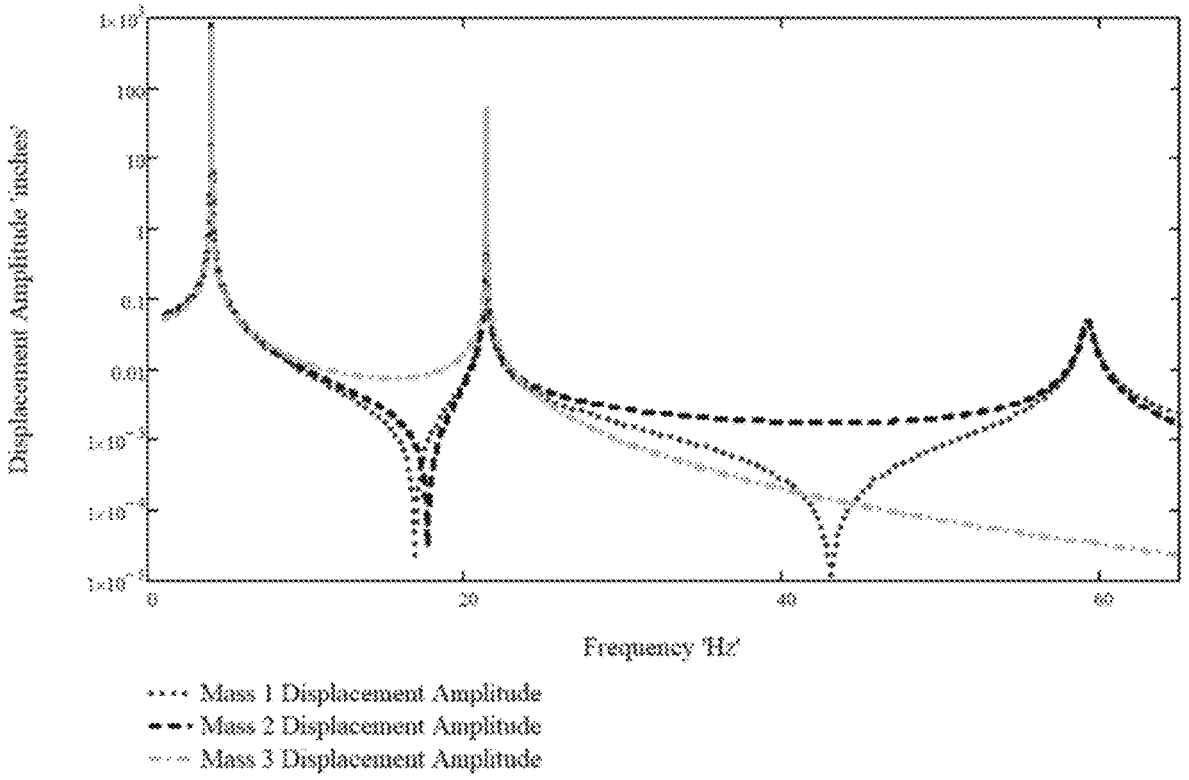
FIG. 20 plots the displacement of amplitude (inches) for the system as function of frequency (Hz) and the number of masses (1, 2 or 3).
Figure 21:
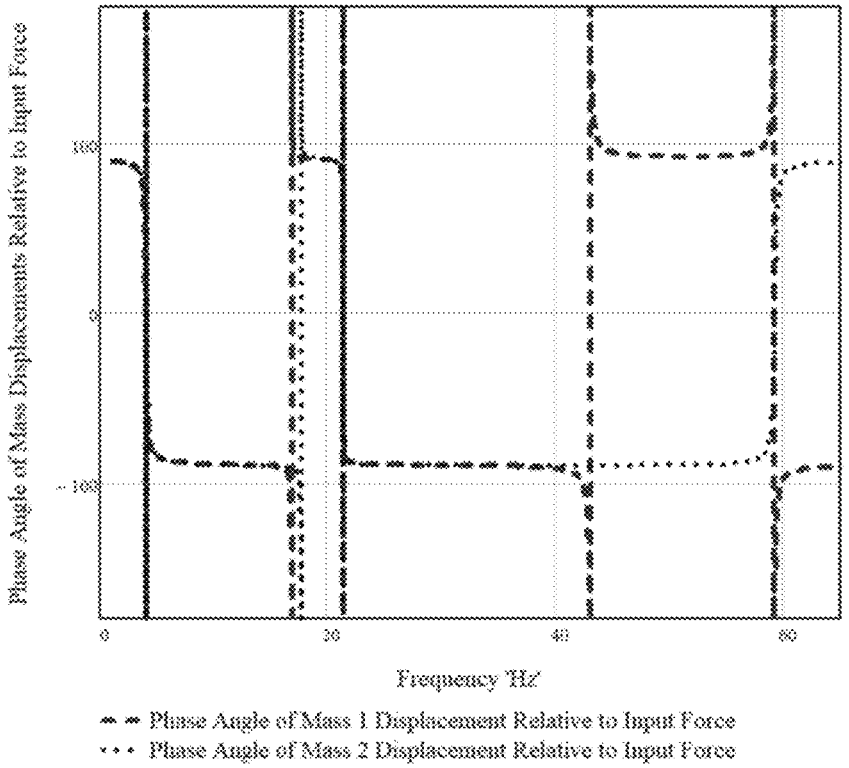
FIG. 21 plots the phase angle of mass displacements relative to input force for one-mass and two-mass systems.
Figure 22:
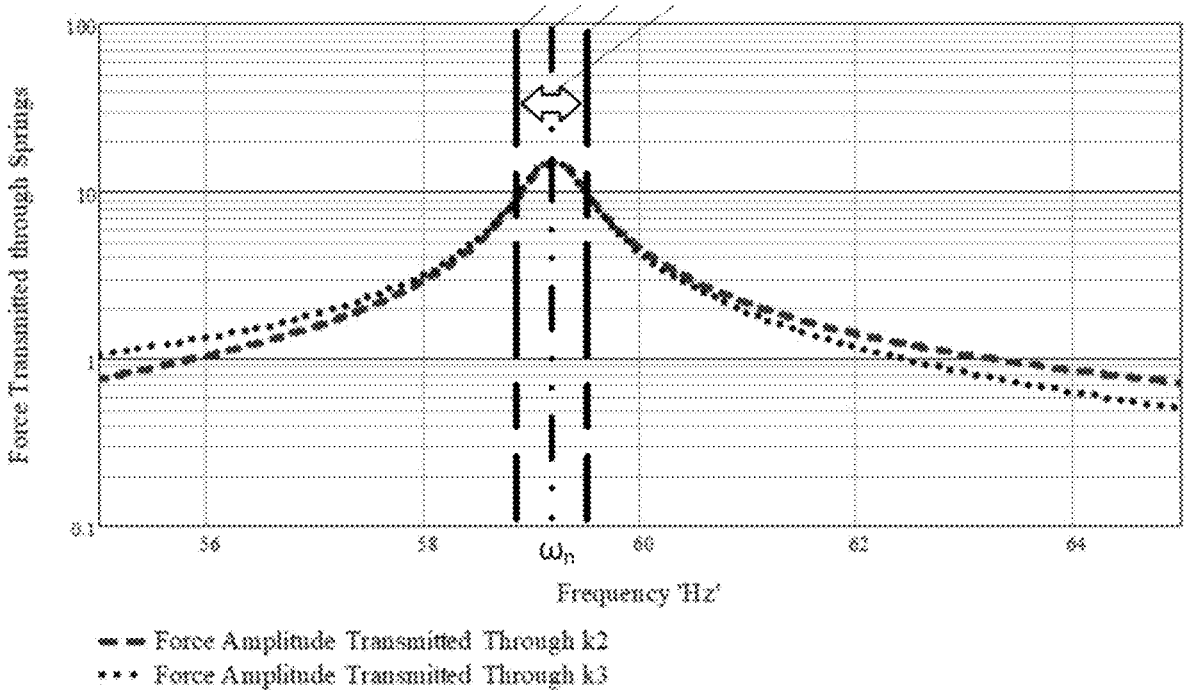
FIG. 22 plots the force transmitted through the springs of disclosed mechanical resonant systems measured in pounds force as a function of frequency (Hz).

FIG. 20 plots the displacement of amplitude (inches) for the system as function of frequency (Hz) and the number of masses (1, 2 or 3). FIG. 21 plots the phase angle of mass displacements relative to input force for one-mass and two-mass systems. FIG. 22 plots the force transmitted through the springs of disclosed mechanical resonant systems measured in pounds force as a function of frequency (Hz). The force of Mass 2 through k3 is higher than the Force of Mass 1 through k2 below resonance ($\omega_n$). The force of Mass 1 through k2 is higher than the Force of Mass 2 through k3 above resonance ($\omega_n$). In many embodiments, the operating frequency is typically between the −3 dB drop in power values on each side of the resonant peak. The resultant −3 dB drop is calculated as the peak value multiplied by sqrt(2)/2. For example, when the peak is 14.65 lbf (pounds force), the −3 dB drop value is 10.36 lbf.

In certain embodiments, the system also acts as a sensor. Based on the resonant frequency of the system, the vacuum level can be calculated. For example, the resonant system dynamics change based on whether the system has a load. When the vacuum is being pulled, load is large. Once the vacuum has been achieved and there is no further pumping, the load goes to zero and the system dynamics change. The spring rate also changes as the vacuum is pulled, which causes the resonant frequency to shift.

Although the disclosure described herein is susceptible to various modifications and alternative iterations, specific embodiments thereof have been described in greater detail above. It should be understood, however, that the detailed description of the composition is not intended to limit the disclosure to the specific embodiments disclosed. Rather, it should be understood that the disclosure is intended to cover all modifications, equivalents, and alternatives falling within the spirit and scope of the disclosure as defined by the claim language.

When introducing elements of the present disclosure or the embodiments(s) thereof, the articles "a," "an," "the," and "said" are intended to mean that there are one or more of the elements. The terms "comprising," "including," and "having" are intended to be inclusive and mean that there may be additional elements other than the listed elements.

Having described the disclosure in detail, it will be apparent that modifications and variations are possible without departing from the scope of the disclosure defined in the appended claims.

EXAMPLES

The following examples are included to demonstrate certain embodiments of the disclosure. It should be appreciated by those of skill in the art that the techniques disclosed in the examples represent techniques discovered by the inventors to function well in the practice of the disclosure. Those of skill in the art should, however, in light of the present disclosure, appreciate that many changes can be made in the specific embodiments that are disclosed and still obtain a like or similar result without departing from the spirit and scope of the disclosure, therefore all matter set forth is to be interpreted as illustrative and not in a limiting sense.

TABLE 1

| Reference numerals | |
|---|---|
| 100 | system |
| 110 | first pump |
| 112 | pump head |
| 114 | piston |
| 116 | barrel |
| 120 | second pump |
| 122 | pump head |
| 124 | piston |
| 126 | barrel |
| 130 | third pump |
| 132 | pump head |
| 134 | piston |
| 136 | barrel |
| 140 | fourth pump |
| 142 | pump head |
| 144 | piston |
| 146 | barrel |
| 150 | first washer |
| 155 | second washer |
| 200 | masses |
| 210 | first mass assembly |
| 211 | mass plate |
| 212 | notch |
| 213 | first spacer |
| 214 | first ring |
| 215 | second spacer |
| 216 | second ring |
| 217 | first bolt |
| 218 | hole |
| 219 | second bolt |
| 220 | second mass assembly |
| 221 | second mass plate |
| 222 | notch |
| 223 | first spacer |
| 224 | first ring |
| 225 | second spacer |
| 226 | second ring |
| 227 | first bolt |
| 228 | hole |
| 229 | second bolt |
| 230 | third mass assembly |
| 231 | mass plate |
| 232 | notch |
| 233 | first spacer |
| 234 | first ring |
| 235 | second spacer |
| 236 | second ring |
| 300 | frame |
| 310 | first plate |
| 320 | second plate |
| 330 | third plate |
| 340 | fourth plate |
| 350 | standoff |
| 351 | first nut |
| 352 | second nut |
| 353 | third nut |
| 354 | fourth nut |
| 355 | fifth nut |
| 356 | sixth nut |
| 357 | seventh nut |
| 358 | eighth nut |
| 359 | foot |
| 400 | resilient members |
| 410 | frame-to-mass spring |

TABLE 1-continued

| Reference numerals | |
|---|---|
| 420 | mass-to-frame spring |
| 430 | ring-to-mass spring |
| 440 | mass-to-ring spring |
| 450 | frame-to-ground spring |
| 500 | voice coil actuator |
| 510 | magnet |
| 520 | magnet housing |
| 530 | bobbin |
| 540 | magnet housing bolt |
| 550 | magnet flex director |
| 600 | force function |
| 700 | testing schematic |
| 710 | signal generator |
| 720 | oscilloscope |
| 730 | signal conditioner |
| 740 | amplifier |
| 750 | current probe |
| 760 | voltage probe |
| 770 | accelerometer |
| 780 | signal generator junction |
| 781 | oscilloscope junction |
| 782 | amplifier junction |
| 783 | amplifier-to-current probe connector |
| 784 | current probe-to-oscilloscope connector |
| 785 | current probe-to-voltage probe connector |
| 786 | voltage probe-to-oscilloscope connector |
| 787 | oscilloscope-to-signal conditioner connector |
| 788 | signal connector-to-accelerometer connector |
| 789 | voltage probe-to-system connector |
| 800 | ground |

Example 1

A mechanical resonant system was built and configured as a vacuum pump. The pump used a vacuum pump head from a KNF UN838KNI Vacuum Pump. The moving mass attached to the piston of the pump was designed as described herein. When tested, it was shown that the system operated on and near mechanical resonance.

Figure 23:
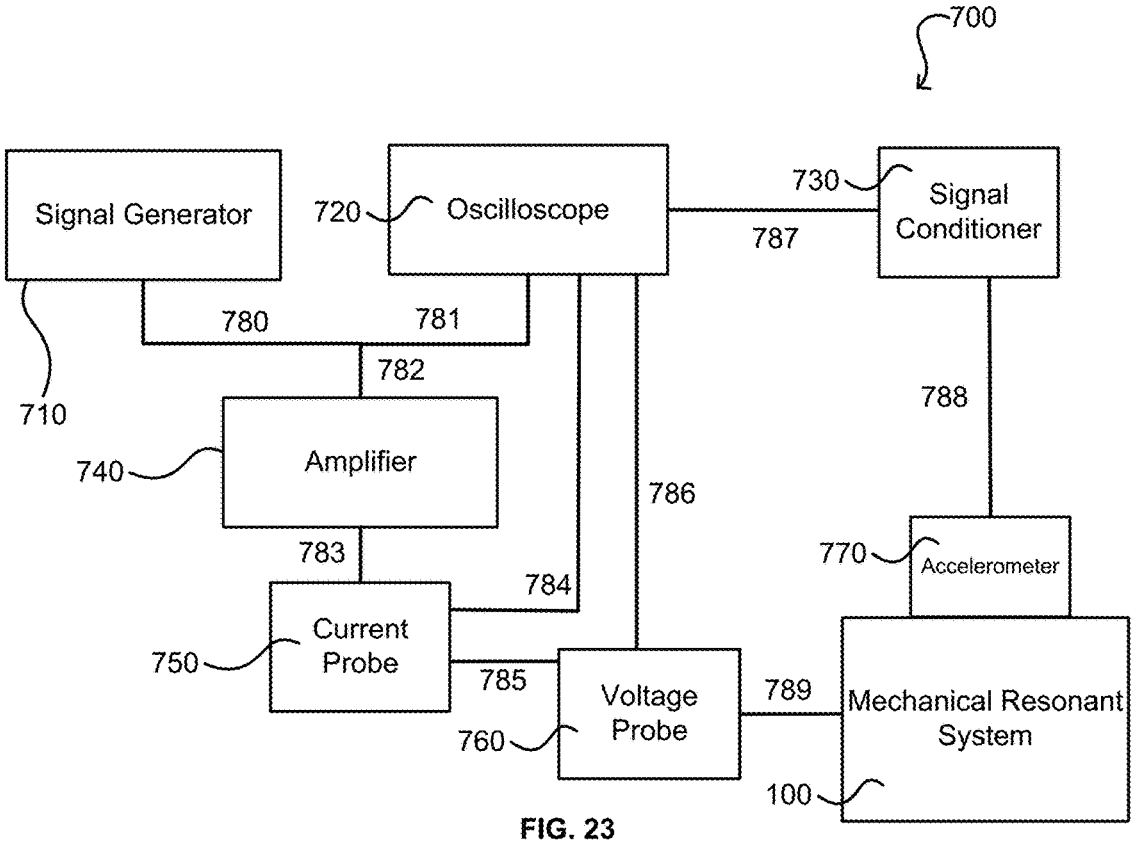
FIG. 23 shows a testing schematic for systems disclosed herein. The schematic comprises a signal generator, oscilloscope, amplifier, signal conditioner, current probe, voltage probe, accelerometer, and a mechanical resonance system.
Figure 24:
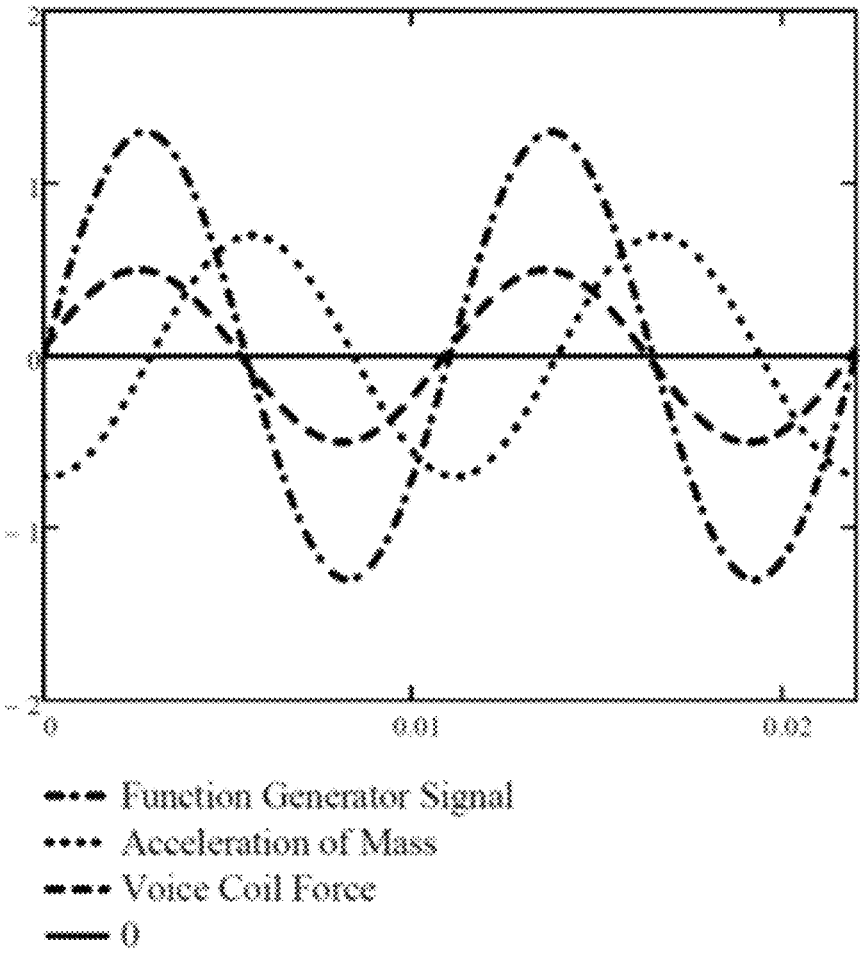
FIG. 24 shows the signals from an embodiment of the disclosed system measured during testing using the schematic of FIG. 23, including the function generator signal, the resultant acceleration response, voice coil force (current-to-voice coil), and reference line at zero.

FIG. 23 shows a testing schematic used, comprising a signal generator 710, oscilloscope 720, amplifier 740, signal conditioner 730, current probe 750, voltage probe 760, accelerometer 770, and a mechanical resonance system 100. FIG. 24 shows the signals from testing using the testing schematic of FIG. 23, including the function generator signal, the resultant acceleration response, voice coil force (current-to-voice coil), and reference line at zero. On mechanical resonance the acceleration response was phase shifted 90° from the voice coil force. On FIG. 24, the phase was close to 90°. These responses are also represented in the following system of equations:

$$f_{Hz} := \left(\frac{.011}{1}\right)^{-1} \text{Hz} = 90.909 \text{ Hz} \tag{3}$$

$$\omega := f_{Hz} \cdot 2 \cdot \pi \tag{4}$$

$$t := 0s, 0.0001s \ldots \frac{2}{f_{Hz}} \tag{5}$$

$$\phi_1 := -95 \text{ deg} \tag{6}$$

-continued $$\phi_2 := 5 \text{ deg} \tag{7}$$

$$\phi_1 - \phi_2 = -100 \text{ deg} \tag{8}$$

$$A_1(t) := 1.3\sin(\omega \cdot t) \tag{9}$$

$$A_2(t) := 0.7 \cdot \sin(\omega \cdot t + \phi_1) \tag{10}$$

$$A_3(t) := 0.5 \cdot \sin(\omega \cdot t + \phi_2) \tag{11}$$

$$A_4(t) := 0.0 \cdot \sin(\omega \cdot t + \phi_2) \tag{12}$$

Figure 25:
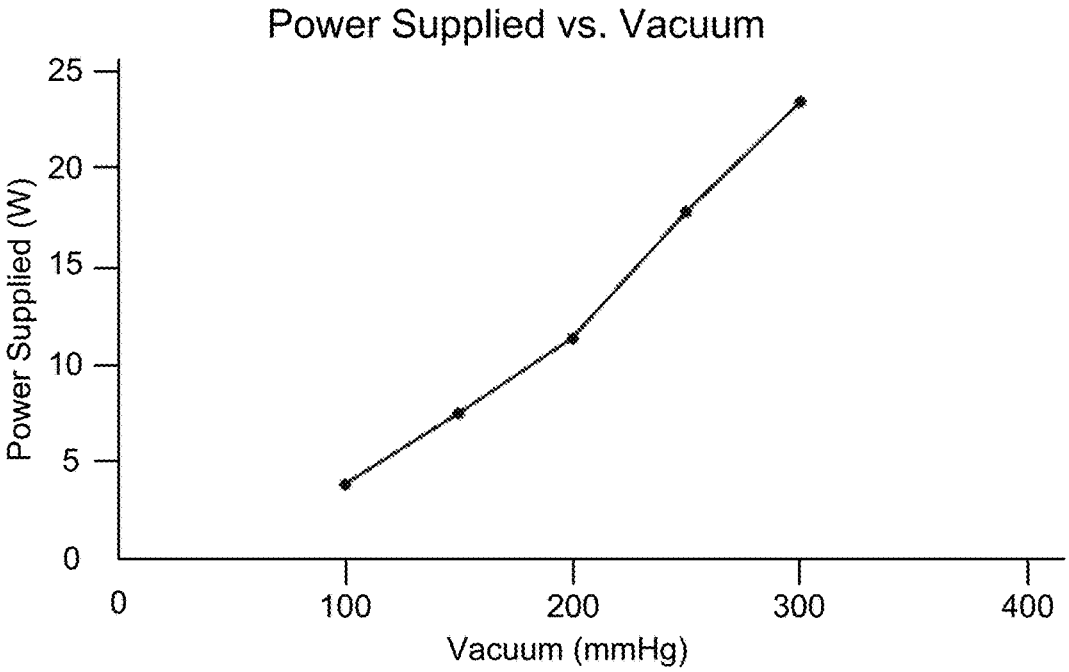
FIG. 25 shows power data from the test conducted in FIG. 24 on the schematic of FIG. 23.

FIG. 25 shows power data from the test conducted in FIG. 24 on the schematic of FIG. 23. For comparison, an off-the-shelf system uses 75 Watts for all vacuum values, because it is a rotary piston style and has a fixed piston displacement. In contrast, the mechanical resonant system has variable displacement that can be controlled. After further development, full vacuum will be achieved at various flow rates.

The foregoing description is given for clearness of understanding only, and no unnecessary limitations should be understood therefrom, as modifications within the scope of the disclosure may be apparent to those having ordinary skill in the art. Throughout the specification, where compositions are described as including components or materials, it is contemplated that the compositions can also consist essentially of, or consist of, any combination of the recited components or materials, unless described otherwise. Likewise, where methods are described as including steps, it is contemplated that the methods can also consist essentially of, or consist of, any combination of the recited steps, unless described otherwise. The disclosure illustratively disclosed herein suitably may be practiced in the absence of any element or step which is not specifically disclosed herein.

The practice of a method disclosed herein, and individual steps thereof, can be performed manually and/or with the aid of or automation provided by electronic equipment. Although processes have been described with reference to embodiments, a person of ordinary skill in the art will readily appreciate that other ways of performing the acts associated with the methods may be used. For example, the order of various of the steps may be changed without departing from the scope or spirit of the method, unless described otherwise. In addition, some of the individual steps can be combined, omitted, or further subdivided into additional steps.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination. All combinations of the embodiments pertaining to the chemical groups represented by the variables contained within the generic chemical formulae described herein are specifically embraced by the present invention just as if each and every combination was individually explicitly recited, to the extent that such combinations embrace stable compounds (i.e., compounds that can be isolated, characterized and tested for biological activity). In addition, all subcombinations of the chemical groups listed in the embodiments describing such variables, as well as all subcombinations of uses and medical indications described herein, are also specifically embraced by the present invention just as if each and every subcombination of chemical groups and subcombination of uses and medical indications was individually and explicitly recited herein.

All patents, publications and references cited herein are hereby fully incorporated by reference. In case of conflict between the present disclosure and incorporated patents, publications and references, the present disclosure should control.

What is claimed is:

1. A mechanical resonant system, comprising:

a frame comprising a plurality of plates and a plurality of standoffs;

at least one pair of pumps disposed on opposite sides of the frame, each of the at least one pair of pumps comprising a pump head, a piston, and a barrel, wherein each piston is disposed within each barrel and beneath each pump head;

two masses operatively coupled to the frame by a first plurality of resilient members;

a second plurality of resilient members coupling the two masses to each other; and at least one voice coil actuator disposed between and coupled to each of the at least one pair of pumps, the at least one voice coil actuator comprising a bobbin, a magnet, and a magnet housing;

wherein the piston of one pump of the at least one pair of pumps is coupled to the bobbin, and the piston of another pump of the at least one pair of pumps is coupled to the magnet housing.

2. The system of claim 1, comprising one pair of pumps disposed on opposite sides of the frame.

3. The system of claim 1, comprising two pairs of pumps disposed on opposite sides of the frame.

4. The system of claim 1, wherein the two masses comprise a mass assembly comprising a mass plate, a plurality of spacers, and at least one ring.

5. The system of claim 1, wherein the first plurality of resilient members comprises springs.

6. The system of claim 1, wherein the system has a resonance frequency, and when the system is in resonance, an input force is in phase with the velocity of each of the two masses.

7. The system of claim 1, further comprising one or more selected from the group consisting of a signal generator, oscilloscope, signal conditioner, amplifier, current probe, voltage probe, and accelerometer.

8. The system of claim 1, further comprising a third plurality of resilient members disposed between the frame and ground, whereby the frame functions as a third mass in the system.

9. A method for evacuating a chamber, comprising operating the system of claim 1 in fluid communication with the chamber.

10. The method of claim 9, wherein one pump of the at least one pair of pumps pulls and the other pump of the at least one pair of pumps pushes.

11. The system of claim 9, wherein the system has a resonance frequency, and when the system is in resonance, an input force is in phase with the velocity of each of the two masses.

12. A method for compressing air, comprising operating the system of claim 1.

13. The system of claim 12, wherein the system has a resonance frequency, and when the system is in resonance, an input force is in phase with the velocity of each of the two masses.

14. The system of claim 1, wherein the second plurality of resilient members comprises springs.

* * * * *